US008091936B1

(12) United States Patent
Graziano

(10) Patent No.: US 8,091,936 B1
(45) Date of Patent: Jan. 10, 2012

(54) GRIPPING DEVICE

(76) Inventor: Michael V. Graziano, Queen Creek, AZ (US)

( * ) Notice: Subject to any disclaimer, the term of this patent is extended or adjusted under 35 U.S.C. 154(b) by 0 days.

(21) Appl. No.: 12/930,855

(22) Filed: Jan. 19, 2011

Related U.S. Application Data

(60) Provisional application No. 61/337,751, filed on Feb. 10, 2010.

(51) Int. Cl.
*B25B 9/00* (2006.01)

(52) U.S. Cl. ..... 294/99.2

(58) Field of Classification Search ..... 294/11, 294/16, 26, 119, 209, 99.2
See application file for complete search history.

(56) References Cited

U.S. PATENT DOCUMENTS

| | | | | | |
|---|---|---|---|---|---|
| 613,355 | A | * | 11/1898 | Burton | 294/3 |
| 2,292,422 | A | * | 8/1942 | Wynnyk | 294/99.2 |
| 3,253,327 | A | * | 5/1966 | McElligatt | 29/741 |
| 3,906,657 | A | * | 9/1975 | Bosch | 119/536 |
| 4,212,305 | A | * | 7/1980 | Lahay | 294/99.2 |
| D259,913 | S | | 7/1981 | Wahlberg | |
| 4,941,700 | A | * | 7/1990 | Lin et al. | 294/99.2 |
| 5,655,806 | A | * | 8/1997 | Halladay et al. | 294/28 |
| 7,124,786 | B1 | | 10/2006 | Gowhari | |
| 7,313,989 | B1 | | 1/2008 | Tortolani | |

* cited by examiner

*Primary Examiner* — Paul T Chin
(74) *Attorney, Agent, or Firm* — Emery L. Tracy

(57) ABSTRACT

A gripping device for retrieving goods from hard to reach or tight fitting spaces is provided. The gripping device comprises a first arm having a first end and a second end and a second arm having a first end and a second end with the first arm being pivotally attached to the second arm at a point between the first ends and the second ends. A first duckbill pincer-like clamp is secured to the second end of the first arm with a thickness of the first clamp being less than the width of the first clamp. A second duckbill pincer-like clamp is secured to the second end of the second arm with a thickness of the second clamp being less than the width of the second clamp. A spring member biases the first ends of the first arm and the second arm in a general direction away from each other. Upon maneuvering the first ends of the first arm and the second arm in a general direction toward each other, the second ends of the first arm and the second arm also move in a general direction toward each other. Upon the second ends of the first arm and the second arm being maneuvered together, an inside surface of the first clamp rests completely against an inside surface of the second clamp.

20 Claims, 3 Drawing Sheets

GRIPPING DEVICE

The present application claims the benefit of priority of pending provisional patent application Ser. No. 61/337,751, filed on Feb. 10, 2010, entitled "Grabber Grip".

BACKGROUND OF THE INVENTION

1. Field of the Invention

This invention relates generally to a gripping device and, more particularly, the invention relates to a gripping device for retrieving goods from hard to reach or tight fitting spaces.

2. Description of the Prior Art

At one time or another, just about everyone has experienced the frustrating scenario of trying to retrieve a much needed object from a tight fitting or hard to reach space. Whether a busy executive who has accidentally dropped his car keys through a drainage grate only to find that they are mere inches away from easy reach; a busy homemaker who watches helplessly as a favorite family recipe falls off the countertop and lands in the narrow valley between the countertop and the stove; or a fashion conscious teen who, even standing on the tip of her toes, cannot reach a favorite hat carelessly tossed on a closet shelf, attempting to access goods that are out of reach or wedged in tight spaces can be a complete hassle. While retrieving goods trapped in tight or hard to reach spaces can be challenging for able bodied consumers, this problem can be especially difficult for those who suffer physical limitations and limited mobility. For the countless consumers who suffer back pain, knee problems, and similar maladies, as well as for many senior consumers, straining to reach for a dropped remote control or stooping to pick a fallen receipt off the ground is simply not an option.

SUMMARY

The present invention is a gripping device for retrieving goods from hard to reach or tight fitting spaces. The gripping device comprises a first arm having a first end and a second end and a second arm having a first end and a second end with the first arm being pivotally attached to the second arm at a point between the first ends and the second ends. A first duckbill pincer-like clamp is secured to the second end of the first arm with a thickness of the first clamp being less than the width of the first clamp. A second duckbill pincer-like clamp is secured to the second end of the second arm with a thickness of the second clamp being less than the width of the second clamp. A spring member biases the first ends of the first arm and the second arm in a general direction away from each other. Upon maneuvering the first ends of the first arm and the second arm in a general direction toward each other, the second ends of the first arm and the second arm also move in a general direction toward each other. Upon the second ends of the first arm and the second arm being maneuvered together, an inside surface of the first clamp rests completely against an inside surface of the second clamp.

In addition, the present invention includes a method for retrieving goods from hard to reach or tight fitting spaces. The method comprises providing a first arm having a first end and a second end, providing a second arm having a first end and a second end, pivotally attaching the first arm to the second arm at a point between the first ends and the second ends, securing a first duckbill pincer-like clamp to the second end of the first arm, constructing a thickness of the first clamp being less than the width of the first clamp, securing a second duckbill pincer-like clamp to the second end of the second arm, constructing a thickness of the second clamp being less than the width of the second clamp, biasing the first ends of the first arm and the second arm in a general direction away from each other, maneuvering the first ends of the first arm and the second arm in a general direction toward each other, moving the second ends of the first arm and the second arm in a general direction toward each other, and resting an inside surface of the first clamp completely against an inside surface of the second clamp.

The present invention further includes a gripping device for retrieving goods from hard to reach or tight fitting spaces. The gripping device comprises a first arm having a first end and a second end and a second arm having a first end and a second end with the first arm being pivotally attached to the second arm at a point between the first ends and the second ends. A first waffled duckbill pincer-like clamp is secured to the second end of the first arm with a thickness of the first clamp being less than the width of the first clamp. A second waffled duckbill pincer-like clamp is secured to the second end of the second arm with a thickness of the second clamp being less than the width of the second clamp. A spring member biases the first ends of the first arm and the second arm in a general direction away from each other. The first ends of the first arm and the second arm are curved outward away from each other forming a substantial oval configuration moved together. Upon maneuvering the first ends of the first arm and the second arm in a general direction toward each other, the second ends of the first arm and the second arm also move in a general direction toward each other. Upon the second ends of the first arm and the second arm being maneuvered together, an inside surface of the first clamp resting completely against an inside surface of the second clamp.

DETAILED DESCRIPTION OF THE PREFERRED EMBODIMENTS

Figure 2:
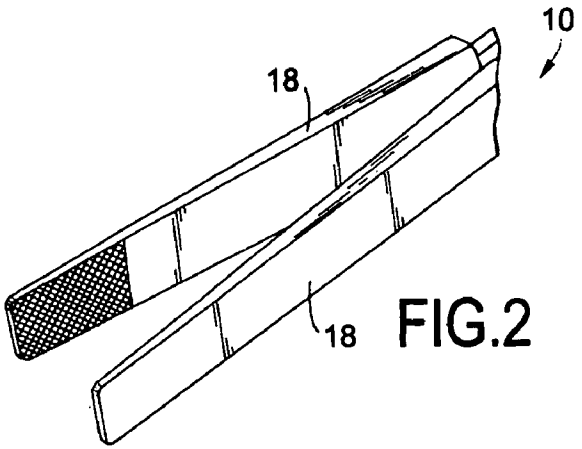
FIG. 2 is a perspective view illustrating gripping arms of the gripping device, constructed in accordance with the present invention.
Figure 3:
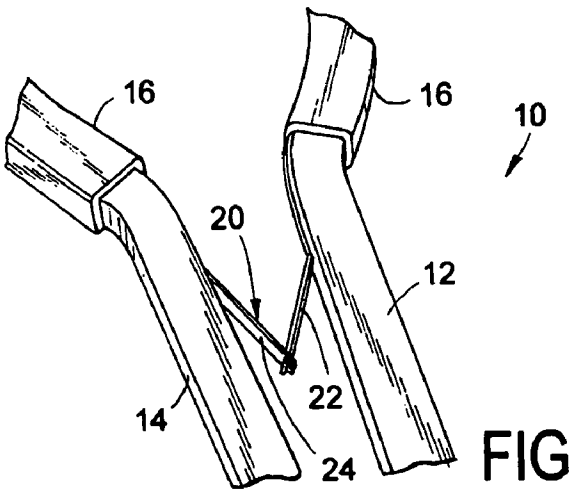
FIG. 3 is a perspective view illustrating handles and a spring member of the gripping device, constructed in accordance with the present invention.
Figure 1:
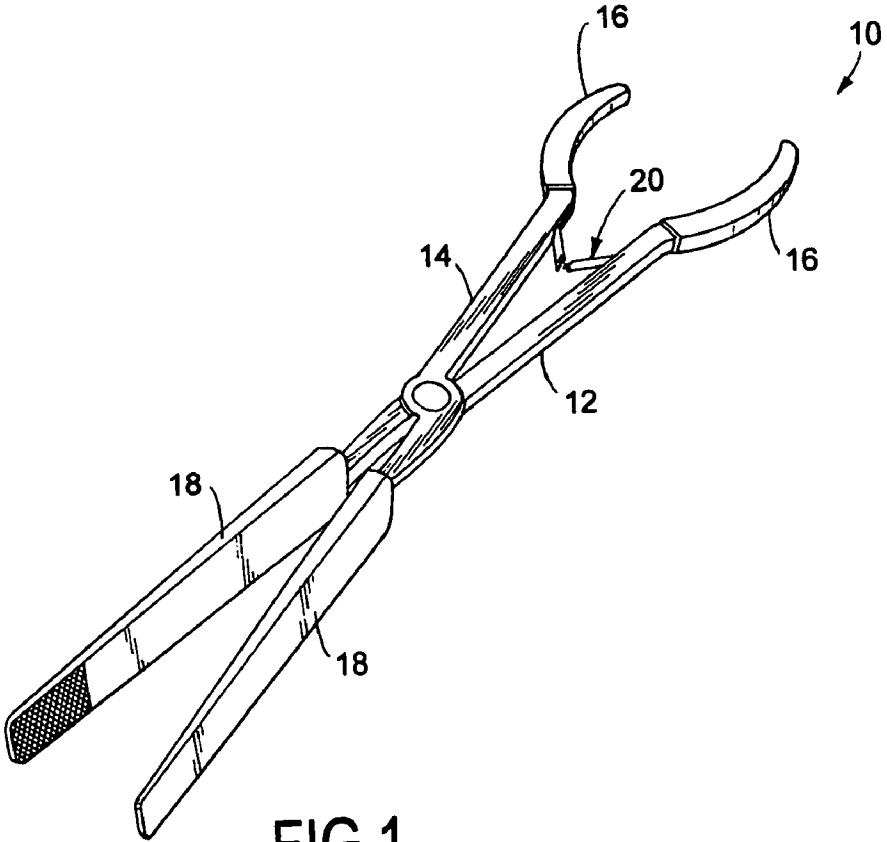
FIG. 1 is a perspective view illustrating a gripping device, constructed in accordance with the present invention.
Figure 4:
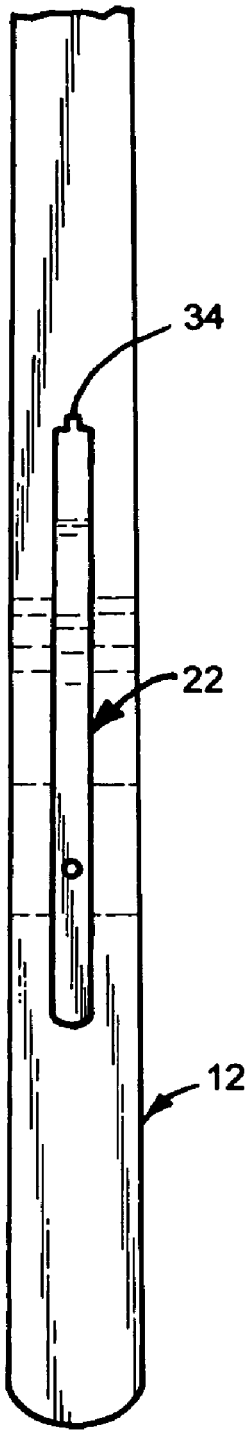
FIG. 4 is an elevational rear view illustrating a first gripping arm of the gripping device, constructed in accordance with the present invention, with a first spring member secured to the first gripping arm.
Figure 5:
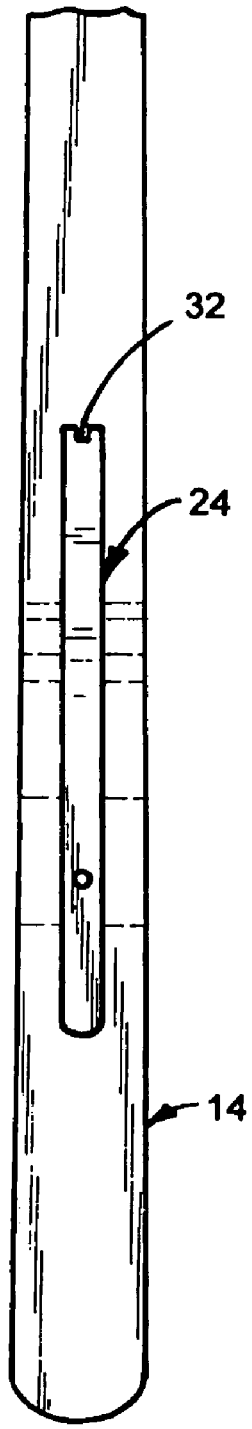
FIG. 5 is an elevational rear view illustrating a second gripping arm of the gripping device, constructed in accordance with the present invention, with a second spring member secured to the second gripping arm.
Figure 6:
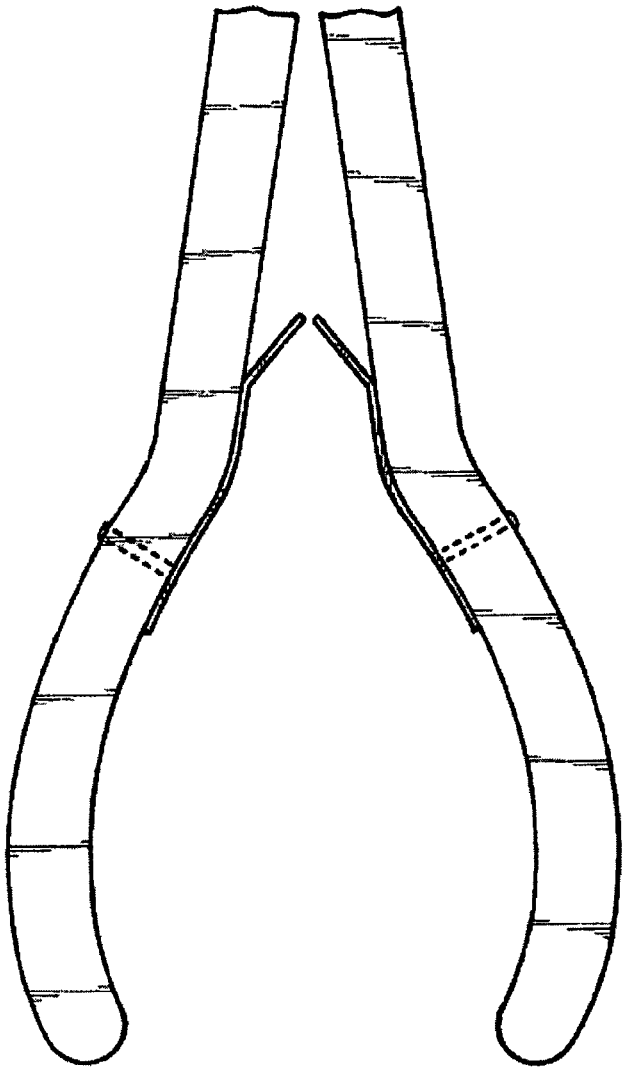
FIG. 6 is an elevational side view illustrating the interaction of the first and second spring members of the gripping device, constructed in accordance with the present invention.
Figure 7:
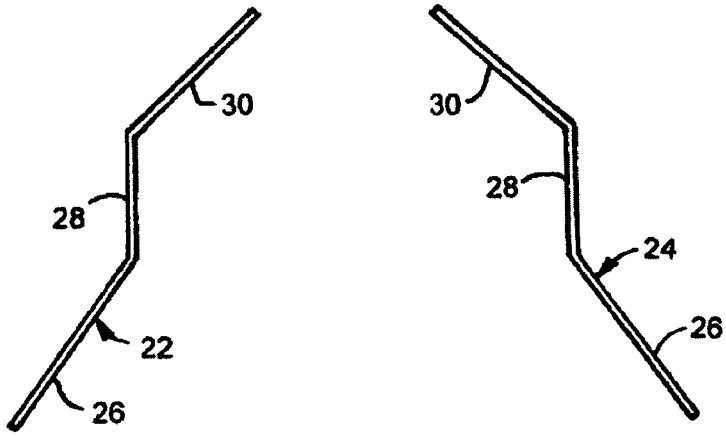
FIG. 7 is an elevational side view illustrating the spring member of the gripping device, constructed in accordance with the present invention.

As illustrated in FIGS. 1-7, the present invention is a gripping device, indicated generally at 10, for retrieving goods from hard to reach or tight fitting spaces. The gripping device 10 of the present invention has a first arm 12 and a second arm 14 with the first arm 12 and the second arm 14 each having a first end and a second end. The first arm 12 and the second arm 14 are pivotally attached together at a point between the first ends and the second ends such that when the first ends of the first arm 12 and the second arm 14 are maneuvered in a general direction toward each other, the second ends of the first arm 12 and the second arm 14 also move in a general direction toward each other.

Preferably, measuring approximately fourteen (14") inches in total length and an open jaw span of approximately one and one-half (1½") inches, the gripping device 10 is preferably manufactured of heavy-duty stainless steel or comparable metal material and features other components, such as rubber and the like, as will be described further below. Other materials are within the scope of the present invention.

The first ends of the first arm 12 and the second arm 14 of the gripping device 10 of the present invention are formed into handles 16 for operating the gripping device 10. In a preferred embodiment, both of the handles 16 feature integrally attached plier-like grips measuring approximately four (4") inches in length. In addition, the handles 16 can have a nonskid rubber coating facilitating a firm and comfortable grip on the first ends of the first arm 12 and the second arm 14 of the gripping device 10. Preferably the first ends of both the first arm 12 and the second arm 14 are curved outward away from each other thereby forming the handles 16 and allowing a user to grasp the first ends of the first arm 12 and the second arm 14 and maneuver the first ends completely together without interference from the user's hands.

The second ends of the first arm 12 and the second arm 14 of the gripping device 10 of the present invention each have a duckbill pincer-like clamp 18 attached thereto. Each clamp 18 is secured to the second end of either the first arm 12 or the second arm 14 and is preferably manufactured of waffled metal material allowing better gripping. Preferably measuring approximately five (5") inches in length, one (1") inch in width at the base of the clamp 18, and three-quarters (¾") inch at the tapered end of the clamp 18, the clamps 18 preferably measure a mere one-eighth (⅛") inch, thus easily sliding beneath and between tight fitting spaces, while also protecting the finish of delicate or fragile items.

The gripping device 10 of the present invention has a spring member 20 for biasing the first ends of the first arm 12 and the second arm 14 in a general direction away from each other. The spring member 20 comprises a first spring member 22 and a second spring member 24 each having a first end and a second end. In addition, preferably, the first spring member 22 and the second spring member 24 are comprised of three sections: a first section 26, a second section 28, and a third section 30. The second section 28 is angled relative to the first section 26 with the first section 26 and the second section 28 substantially conforming to the contour of the first arm 12 and the second arm 14 maintaining the first section 26 and the second section 28 flush against the inside surfaces of the first arm 12 and the second arm 14 such that during use, the first section 26 and the second section 30 push against the inside surfaces thereby assisting the spring member 20 in urging the first ends of the first arm 12 and the second arm 14 in a general direction away from each other. The third section 30 is angled relative to the second section 28. The first section 26 and the third section 30 can be angled relative to each other or can be substantially parallel. The angling of the sections relative to each other causes the first spring member 24 and the second spring member 26 to resiliently distort during use while biasing the first arm 12 and second arm 14 away from each other during nonuse.

Preferably, the first spring member 22 of the gripping device 10 is mounted to an inside surface of the first arm 12 adjacent the first end of the first arm 12 and the second spring member 24 is mounted to an inside surface of the second arm 14 adjacent the first end of the second arm 14. In a preferred embodiment, a rivet through first sections 26 of the first spring member 22 and the second spring member 24 near the first end of the first spring member 22 and the second spring member 24 secures the first spring member 22 and the second spring member 24 to the first arm 12 and the second arm 14, respectively.

The second end of the second spring member 24 of the gripping device 10 of the present invention has a notch 32 formed therein. The second end of the first spring member 22 has a projection 34 extending therefrom. The notch 32 of the second spring member 24 releasably receives the projection 34 of the first spring member 22 thereby releasably securing the first ends of the first spring member 22 and the second spring member 24 together. In a preferred embodiment, each spring member 22, 24 has a length of approximately two and three-quarters (2¾") inch.

The manner of use of the gripping device 10 of the present invention will now be described. It will be understood by those skilled in the art that the manner of use of the gripping device 10 described herein is merely one method of use and other methods of use of the gripping device 10 are within the scope of the present invention.

Application and use of the gripping device 10 of the present invention is simple and straightforward. The user utilizes the gripping device 10 to easily retrieve objects trapped in hard to reach or tight fitting spaces. Holding the unit by the plier-like handle 16, the user positions the gripping device 10 so that the duckbill clamps 18 are directed to the item they need to grasp. When the waffle duckbill jaws 18 are in the spring-loaded position, the user then squeezes the handles 16 to grab the item and hold the item. The user then pulls back on the gripping device's 10 handle, comfortably retrieving the designated object from the end of the gripping device 10. After use, the gripping device 10 is stored away in a drawer, utility closet, or other easily accessed location until again needed.

The gripping device 10 of the present invention offers users a number of significant benefits and advantages. Foremost, the gripping device 10 provides users a simple and efficient means of retrieving a wide variety of items from tight fitting or hard to reach spaces. Users will appreciate that the fine, gripping waffle clamps 18 of the gripping device 10 enables them to pick up small or delicate items, such as loose change, paper receipts, credit cards, and keys with ease. Further, heavy or oversized goods can be easily and quickly gathered when using the gripping device 10. Whether a loose sock which has fallen behind a clothes dryer, or silver dollar that has rolled beneath a child's dresser, a wide variety of items can be easily accessed. Easily operated by a simple squeeze of the plier-like handles 16, the gripping device 10 can be operated by virtually any consumer, including those not in the best physical shape or health. In this manner, those who suffer limited mobility, back pain and similar maladies will appreciate the gripping device 10. Enabling physically challenged users a simple means of caring for him or herself, the gripping device 10 proves an invaluable tool in maintaining independence. Not limited to use in retrieving lost or hard-to-reach items, the gripping device 10 is a versatile tool which can be utilized for everything from pulling weeds in a flower bed, to flipping meats on a hot grille. As such, the gripping device 10 provides a wide array of useful functions. The gripping device 10 can be easily stored and would take up little space in a utility drawer, storage cabinet, or even vehicle glove compartment.

The gripping device 10 of the present invention enables users to quickly and easily retrieve items from tight fitting or hard to reach spaces. Easily operated, the gripping device 10 proves a valuable commodity in any household.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A gripping device for retrieving goods from hard to reach or tight fitting spaces, the gripping device comprising:

a first arm having a first end and a second end;

a second arm having a first end and a second end, the first arm being pivotally attached to the second arm at a point between the first ends and the second ends;

a first duckbill pincer-like clamp secured to the second end of the first arm, a thickness of the first clamp being less than the width of the first clamp;

a second duckbill pincer-like clamp secured to the second end of the second arm, a thickness of the second clamp being less than the width of the second clamp; and a spring member for biasing the first ends of the first arm and the second arm in a general direction away from each other;

wherein upon maneuvering the first ends of the first arm and the second arm in a general direction toward each other, the second ends of the first arm and the second arm also move in a general direction toward each other; and wherein upon the second ends of the first arm and the second arm being maneuvered together, an inside surface of the first clamp resting completely against an inside surface of the second clamp.

2. The gripping device of claim 1 wherein the first ends of the first arm and the second arm are curved outward away from each other forming a substantial oval configuration moved together.

3. The gripping device of claim 1 wherein the first ends of the first arm and the second arm are covered in a nonskid rubber coating.

4. The gripping device of claim 1 wherein the inside surface of the first clamp and the inside surface of the second clamp is waffled.

5. The gripping device of claim 1 wherein the spring member comprises a first spring member and a second spring member each having a first section, a second section, and a third section, the second section being angled relative to the first section and the second section being angled relative to the third section.

6. The gripping device of claim 5 wherein the first section and the second section substantially conform to the contour of the first arm and the second arm thereby maintaining the first section and the second section flush against inside surfaces of the first arm and the second arm.

7. The gripping device of claim 6 wherein the first section and the third section are substantially parallel to each other.

8. The gripping device of claim 5 wherein a second end of the first spring member has a notch formed therein and a second end of the second spring member has a projection extending therefrom, the notch of the first spring member releasably receiving the projection of the second spring member releasably securing the second ends of the first spring member and the second spring member together.

9. A method for retrieving goods from hard to reach or tight fitting spaces, the method comprising:

providing a first arm having a first end and a second end;

providing a second arm having a first end and a second end;

pivotally attaching the first arm to the second arm at a point between the first ends and the second ends;

securing a first duckbill pincer-like clamp to the second end of the first arm;

constructing a thickness of the first clamp being less than the width of the first clamp;

securing a second duckbill pincer-like clamp to the second end of the second arm;

constructing a thickness of the second clamp being less than the width of the second clamp;

biasing the first ends of the first arm and the second arm in a general direction away from each other;

maneuvering the first ends of the first arm and the second arm in a general direction toward each other;

moving the second ends of the first arm and the second arm in a general direction toward each other; and resting an inside surface of the first clamp completely against an inside surface of the second clamp.

10. The method of claim 9 and further comprising:

curving the first ends of the first arm and the second arm outward away from each other forming a substantial oval configuration moved together.

11. The method of claim 9 and further comprising:

covering the first ends of the first arm and the second arm in a nonskid rubber coating.

12. The method of claim 9 wherein the inside surface of the first clamp and the inside surface of the second clamp is waffled.

13. The method of claim 9 and further comprising:

providing a first spring member and a second spring member, each having a first section, a second section, and a third section;

angling the second section relative to the first section; and angling the second section relative to the third section.

14. The method of claim 13 and further comprising:

conforming the first section and the second section substantially to the contour of the first arm and the second arm; and maintaining the first section and the second section flush against inside surfaces of the first arm and the second arm.

15. The method of claim 14 wherein the first section and the third section are substantially parallel to each other.

16. The method of claim 13 and further comprising:

forming a notch in a second end of the first spring member;

forming a projection in a second end of the second spring member;

releasably inserting the projection into the notch; and releasably securing second ends of the first spring member and the second spring member together.

17. A gripping device for retrieving goods from hard to reach or tight fitting spaces, the gripping device comprising:

a first arm having a first end and a second end;

a second arm having a first end and a second end, the first arm being pivotally attached to the second arm at a point between the first ends and the second ends;

a first waffled duckbill pincer-like clamp secured to the second end of the first arm, a thickness of the first clamp being less than the width of the first clamp;

a second waffled duckbill pincer-like clamp secured to the second end of the second arm, a thickness of the second clamp being less than the width of the second clamp;

a spring member for biasing the first ends of the first arm and the second arm in a general direction away from each other;

wherein the first ends of the first arm and the second arm are curved outward away from each other forming a substantial oval configuration moved together;

wherein upon maneuvering the first ends of the first arm and the second arm in a general direction toward each other, the second ends of the first arm and the second arm also move in a general direction toward each other; and wherein upon the second ends of the first arm and the second arm being maneuvered together, an inside surface of the first clamp resting completely against an inside surface of the second clamp.

18. The gripping device of claim 17 wherein the spring member comprises a first spring member and a second spring member each having a first section, a second section, and a third section, the second section being angled relative to the first section and the second section being angled relative to the third section.

19. The gripping device of claim 18 wherein the first section and the second section substantially conform to the contour of the first arm and the second arm thereby maintaining the first section and the second section flush against inside surfaces of the first arm and the second arm.

20. The gripping device of claim 18 wherein a second end of the first spring member has a notch formed therein and a second end of the second spring member has a projection extending therefrom, the notch of the first spring member releasably receiving the projection of the second spring member releasably securing the first ends of the first spring member and the second spring member together.

* * * * *